United States Patent [19]

Grogan

[11] Patent Number: 5,044,544

[45] Date of Patent: Sep. 3, 1991

[54] MODULAR CARGO CONTAINER

[75] Inventor: Charles W. Grogan, Yardley, Pa.

[73] Assignee: Sea-Land Corporation, Inc., Iselin, N.J.

[21] Appl. No.: 483,252

[22] Filed: Feb. 22, 1990

[51] Int. Cl.[5] ..... B65D 19/08; B65D 88/12

[52] U.S. Cl. ..... 228/119; 29/402.08; 29/402.16

[58] Field of Search ..... 228/119; 29/402.08, 29/402.16; 220/1.5

[56] References Cited

U.S. PATENT DOCUMENTS

| | | | |
|---|---|---|---|
| 2,407,021 | 9/1946 | Langel | 220/23.4 |
| 3,025,995 | 3/1962 | Koelsch et al. | 220/62 |
| 3,047,189 | 7/1962 | Paul | 220/650 |
| 3,265,235 | 8/1966 | Chieger | 220/646 |
| 3,387,734 | 6/1968 | Turpen | 220/1.5 |
| 3,432,909 | 3/1969 | Hopkins | 228/119 |
| 3,456,830 | 7/1969 | Golder | 220/1.5 |
| 3,971,122 | 7/1976 | Bertolini et al. | 220/1.5 |
| 4,094,430 | 6/1978 | Bertolini et al. | 220/1.5 |
| 4,325,488 | 5/1982 | Ketner | 220/1.5 |
| 4,351,230 | 9/1982 | Brickner et al. | 98/31 |
| 4,357,047 | 11/1982 | Katz | 220/1.5 X |

*Primary Examiner*—Kenneth J. Ramsey

*Attorney, Agent, or Firm*—Scully, Scott, Murphy & Presser

[57] ABSTRACT

A modular and stackable cargo container, and a method of protecting such a container. The container comprises a body that defines a cargo space, and that includes a pair of support posts, a header extending between the support posts, and a plurality of post end members connected to the support posts to facilitate handling the cargo container. Energy absorption pads are mounted on the header immediately adjacent the post end members to protect the header from impact damage. In use, container handling equipment may strike and dent the energy absorption pads. After a pad has been dented, it can be cut away from the header, and a replacement pad can be connected to the header to further protect the header from container handling equipment.

5 Claims, 6 Drawing Sheets

MODULAR CARGO CONTAINER

BACKGROUND OF THE INVENTION

This invention generally relates to cargo containers, and more specifically, to the corner construction of modular, stackable cargo containers.

Cargo is frequently shipped in bulk box-shaped containers to reduce handling and to expedite loading and unloading operations. Such containers are often handled by a spreader bar that, in turn, is carried by a crane and superimposed over the containers to engage complementary holding means on the tops of the containers. More specifically, containers of the above-mentioned general type usually include four top corner members, and a spreader bar typically includes four downwardly extending projections or arms that are spaced so that they can be simultaneously inserted into the top corner members of the container. Once inserted into these corner members, the arms of the spreader bar are usually twisted to lock those arms to the corner members so that the spreader bar may be used to carry or lift the container to another location, such as onto a railroad car or onto a ship.

Movement of the twist arms of the spreader bar into the container corner members is usually controlled by a crane operator who may be quite a distance from the container and the spreader bar themselves. As a result, it is difficult to lower the spreader bar so that the locking arms are directly inserted into the co-operating corner members of the containers, and often those arms strike against the roofs of the containers adjacent the corner members. Over time, repeated impacts against a container roof may cause hairline cracks or other small perforations in that roof, allowing liquids such as water to leak into the container. These hairline cracks and perforations are usually very difficult to detect, and often they are only detected after there has been water damage to the container contents.

Cargo containers of the above-mentioned type also often include four bottom corner members that are used to lock the containers onto a support member, which may be, for example, a truck chassis, a railroad car or another modular container. In a typical operation, this support member, whatever it might be, includes four upwardly extending locking pins, and a container is lowered onto or between these locking pins so that they are, or subsequently are, inserted into the bottom corner members of the container. After this, the locking pins may be twisted or turned to lock the container securely to the supporting device. This operation also is normally controlled by a crane operator who lowers the container onto the support member from a distance.

Under the best of conditions, it is difficult to lower the container so that it does not strike the locking pins, and various factors completely outside the control of the crane operator may make this task even more difficult. For instance, a gusty wind may cause a container to swing unevenly as it is lowered onto a railroad car, making it very difficult to position the container directly between container locking pins on the car. Also, when lowering a container onto a ship, wave action may cause the ship to sway enough so that it becomes extremely difficult to position the container directly on the desired location. Consequently, the locking pins on the supporting device occasionally strike the bottom of the floor of the container, adjacent its corner members, and repeated impacts can cause small cracks or perforations in the container floor. Such defects are difficult to observe; and, as with similar defects in the roof of the container, often damage to the container cargo is the first indication that such a crack or perforation may exist.

SUMMARY OF THE INVENTION

An object of the present invention is to prevent hairline cracks or other perforations from forming in the roof or bottom corners of modular cargo containers due to repeated impacts against those corners by locking arms used to lock the containers either to spreader bars or to supporting devices.

Another object of this invention is to provide an energy absorbing pad that will absorb the impact of vertically extending locking arms against either the roof or bottom corners of a modular cargo container.

A further object of the present invention is to provide an energy absorbing pad to protect the roof and bottom corners of a modular cargo container and that will indicate when the pad itself should be replaced to insure adequate continued protection of those container corners.

These and other objectives are obtained with a modular and stackable cargo container comprising a body defining the shape of the container and forming an interior cargo space, and including a roof, a floor, front and back walls, left and right side walls, a pair of support posts, a header extending between the support posts, and a plurality of post end members connected to the support posts to facilitate handling the cargo container. The container further comprises an energy absorption pad mounted on the header immediately adjacent one of the post end members to protect the header from impact damage. In use, container handling equipment may strike and dent the energy absorption pad; and after a pad has been dented, it can be cut away from the container header, and a replacement pad can be connected to the header to further protect the header from container handling equipment.

Further benefits and advantages of the invention will become apparent from a consideration of the following detailed description given with reference to the accompanying drawings, which specify and show preferred embodiments of the invention.

DETAILED DESCRIPTION OF THE PREFERRED EMBODIMENTS

Figure 1:
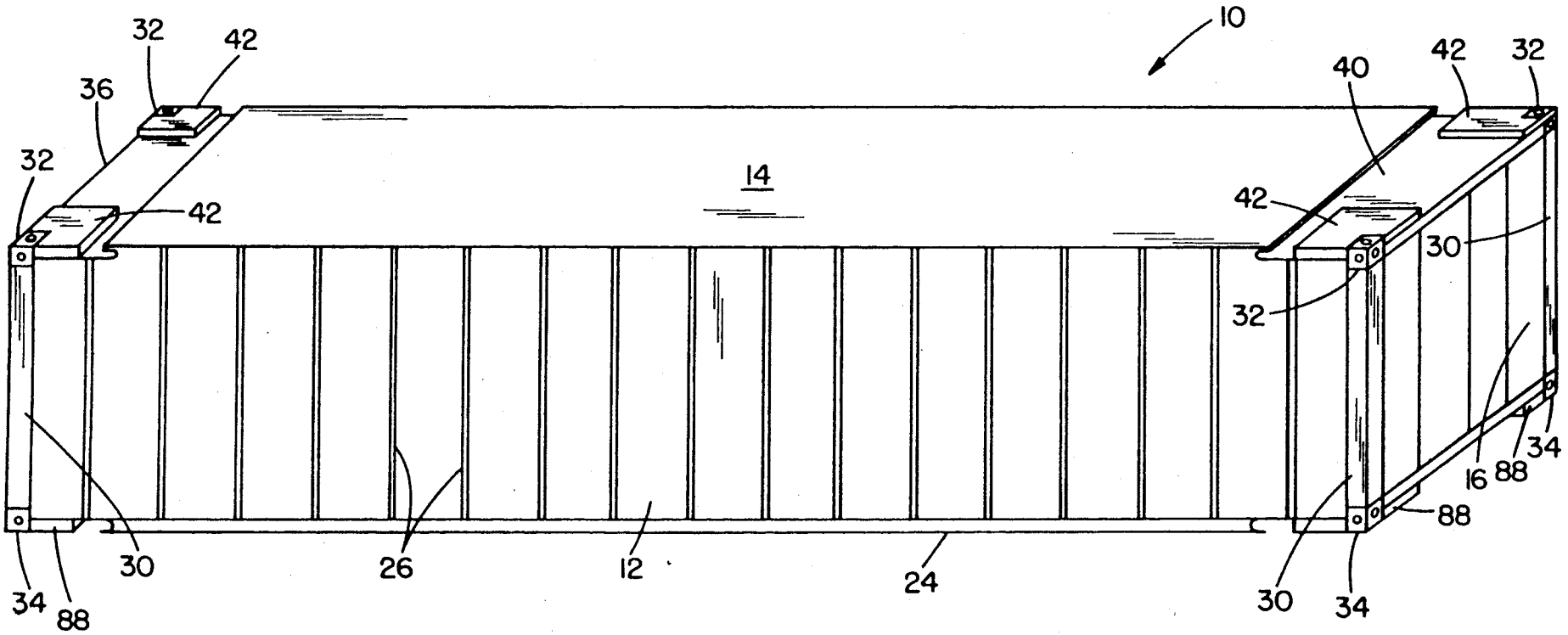
FIG. 1 is a perspective view of a cargo container embodying the present invention.
Figure 2:
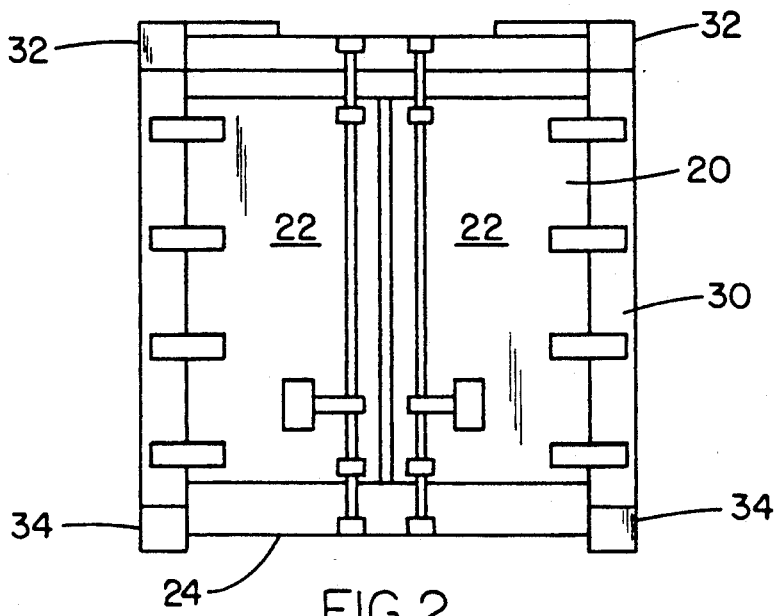
FIG. 2 is a back view of the cargo container.

FIGS. 1 and 2 illustrate cargo container 10 comprising a pair of side walls 12, a top cover or roof 14, a front end wall 16, and a rear end wall 20 including a pair of hinged, outwardly opening doors 22, all mounted on a floor or bottom wall 24. The front and side walls of container 10 are preferably formed of sheet metal panels stiffened by vertical ribs 26, but could also- be made of plywood, fiber glass or other suitable materials used singlely or in combination. The container body is capable of being detachabely secured to a railway flat car or a highway tractor-trailer chassis, and is capable of being hoisted onto a marine vessel where it can be stacked in a column of similiar containers.

In order to support the full weight of a plurality of superposed containers and to transmit that load to the support beneath, container 10 is provided with support posts 30, top post members 32 and bottom post members 34. With the container 10 shown in FIGS. 1 and 2, support posts 30 are located at the corners of the container, and are thus commonly referred to as corner posts. Top and bottom post member 32 and 34 are normally heavy metal castings, and thus are commonly referred to as corner castings. The specific manner of manufacture of elements 32 and 34 forms no part of this invention and their function could be performed as well if they were made otherwise, as by forging, welded fabrication or in any other suitable way. Corner posts 30 are generally of conventional construction and are of a strength sufficient to support a plurality of containers thereabove. Generally, one top corner casting and one bottom corner casting 32 and 34 is welded to the top and bottom, respectively, of each corner post 30 and each of the top and bottom corner castings has at least one recess, socket or opening formed therein to receive a coupling or locking mechanism (not shown) for securing the container to a support member, to another container, or to lift and carry the container by means of a sling or a spreader bar.

Figure 5:
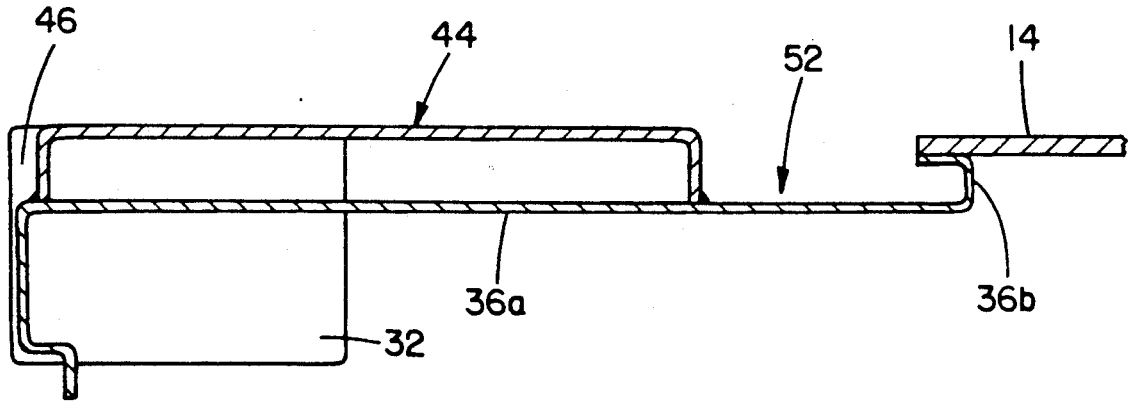
FIG. 5 is a cross-sectional view taken along line V—V of FIG. 3.
Figure 3:
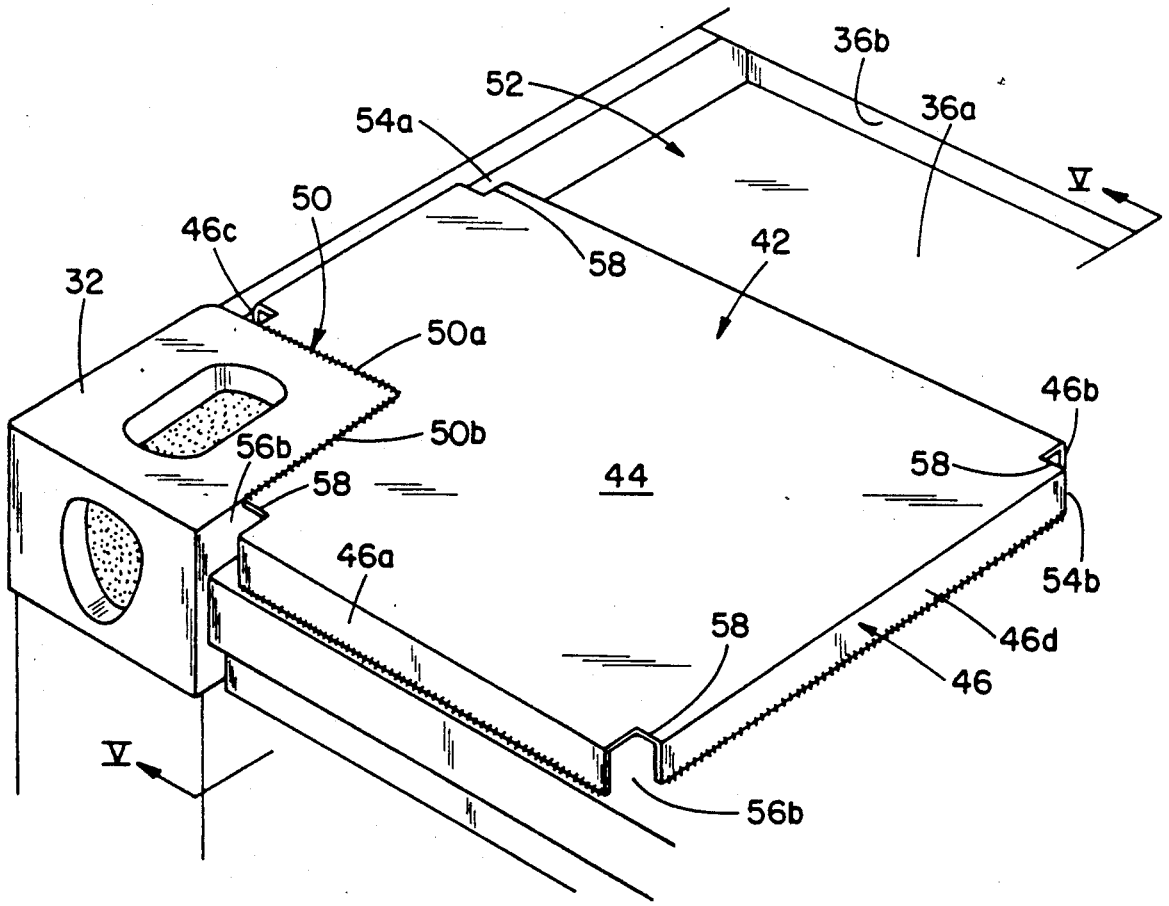
FIG. 3 is a perspective view of a corner of the cargo container.

Roof panel or member 14 is connected to front and back walls 16 and 20 by front and back headers 36 and 40, respectively. With particular reference to FIGS. 3 and 5, front header 36 includes a top horizontal section 36*a* and a rearward U-shaped flange 36*b* and roof 14 is connected to and extends rearward from this U-shaped flange of the front header. Similiarly, back header 40 includes a top horizontal section 40*a* and a forward U-shaped flange 40*b*, and roof 14 is connected to and extends forward from this U-shaped flange of the back header. In this way, headers 36 and 40 and roof panel 14 form a complete cover for container 10 even though the roof may be slightly spaced from the front and back planes of the container.

As previously mentioned, top corner members 32 define one or more recesses or openings that may be used in a conventional manner to carry the container 10, for example, by a spreader bar. The arms of these spreader bars occasionally hit the tops of cargo containers adjacent the corner members; and energy absorption pads 42 are mounted on container 10, specifically front and back headers 36 and 42 and, immediately adjacent top corner members 30, to protect these areas of the container from impact.

Figure 4:
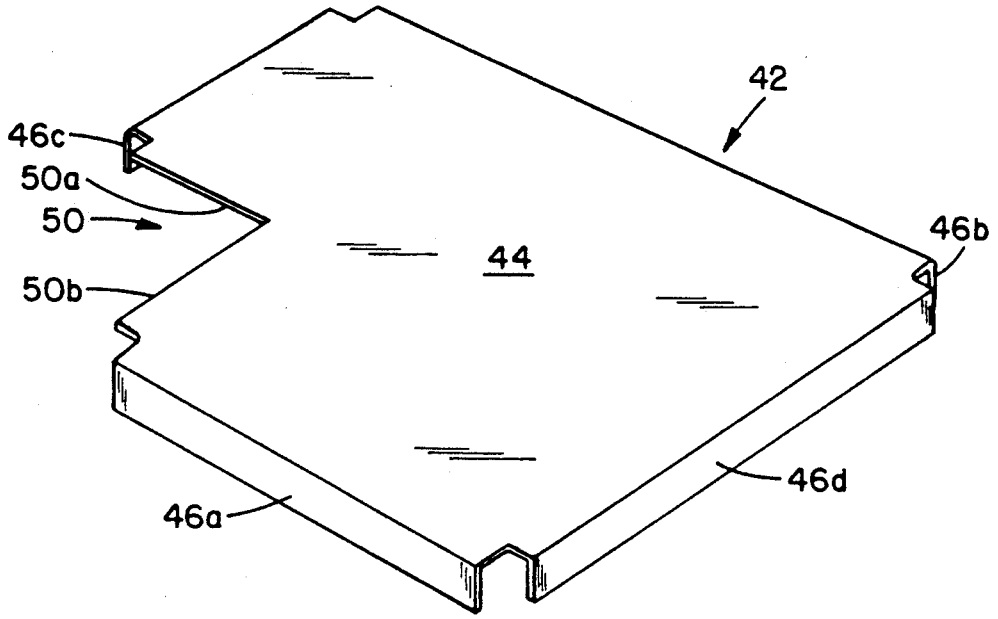
FIG. 4 is a perspective view of an energy absorption pad of the cargo container.

Energy absorption pads 42 are substantially identical and hence only one will be described in detail. With reference to FIGS. 3-5, pad 42 comprises top plate 44 and side member 46; and the side member, in turn, includes front flange 46*a*, back flange 46*b*, and side flanges 46*c* and *d*. Top plate 44 has a generally flat shape, and side member 46 is connected to and extends downward from the top plate. Side member 46 is connected to the body of container 10, specifically, to the top, horizontal section 36*a* of the front header, and the side member normally holds top plate 44 of the energy absorption pad spaced from the container header.

Preferably, absorption pad 42 abutts against corner member 32; and even more preferably, the energy absorption pad forms a corner recess 50, and the corner member 32 fits complementarily into this recess 50, directly against edges 50*a* and *b* of the energy absorption pad that forms recess 50. With the specific embodiment of corner member 32 and absorption pad 42 shown in FIGS. 1-5 , the corner member and recess 50 both have a rectangular shape, with edges of recess 50 abutting against edges of the corner member.

As illustrated in FIGS. 1-3 and 5, the top surface of top plate 44 of absorption pad 42 is co-planer with the top surface of corner member 32. This facilitates sliding a locking arm of a spreader bar, or any other object, over the energy absorption pad 42 and onto corner member 32 in case that arm initially impacts against the energy absorption pad.

With particular reference to FIG. 3, absorption pad 42, roof panel 14, and front header 36 form a shallow recess 52 immediately rearward of the energy absorption pad. To prevent water from collecting in this recess, the energy absorption pad 42 is designed to allow water to drain forward, through the pad; and, in particular, the energy absorption pad 42 is provided with at least one back drain opening and at least one front drain opening to drain liquid through the energy absorption pad, from the area rearward thereof to an area forward of the absorption pad.

Preferably, energy absorption pad 42 includes a multitude of back drain openings 54*a* and *b*, with opening 54*a* formed by spacing apart the back end of side flange 46*c* and the left end of back flange 46*b*, and with opening 54*b* formed by spacing apart the right end of back flange 46*b* and the back end of side flange 46*d*. Similarly, absorption pad 42 includes a multitude of front drain openings 56*a* and *b*, with opening 56*a* formed by spacing apart the front end of flange 46*d* and the right end of flange 46*a*, and with opening 56*b* formed by spacing the left end of flange 46*a* from corner member 32. To facilitate forming openings 54*a* and *b* and 56*a* and *b*, a recess may also be formed in each corner of top plate 44; and these corner recesses 58 preferably have arcuate or semi-circular shaped edges.

With the embodiment of energy absorption pad 42 shown in FIGS. 1-5, flanges 46*a-d* are integrally connected to top plate 44; and indeed, the energy absorption pad may be made by taking a flat sheet of material, cutting away appropriate portions of that sheet to form openings 54*a* and *b* and 56*a* and *b* and recesses 50 and 58, and then stamping the sheet to bend flanges 46*a-d* to a right angle to the top plate 44.

Absorption pad 42 may be secured on the container body in any suitable manner; however, preferably the energy absorption pad is securely welded to the container body. More specifically, bottom edges of flanges 46*a, b* and *d* are securely welded to the top horizontal section 36*a* of front header 36. Edges 50*a* and *b* of recess 50 may also be welded to corner member 32.

Figure 6:
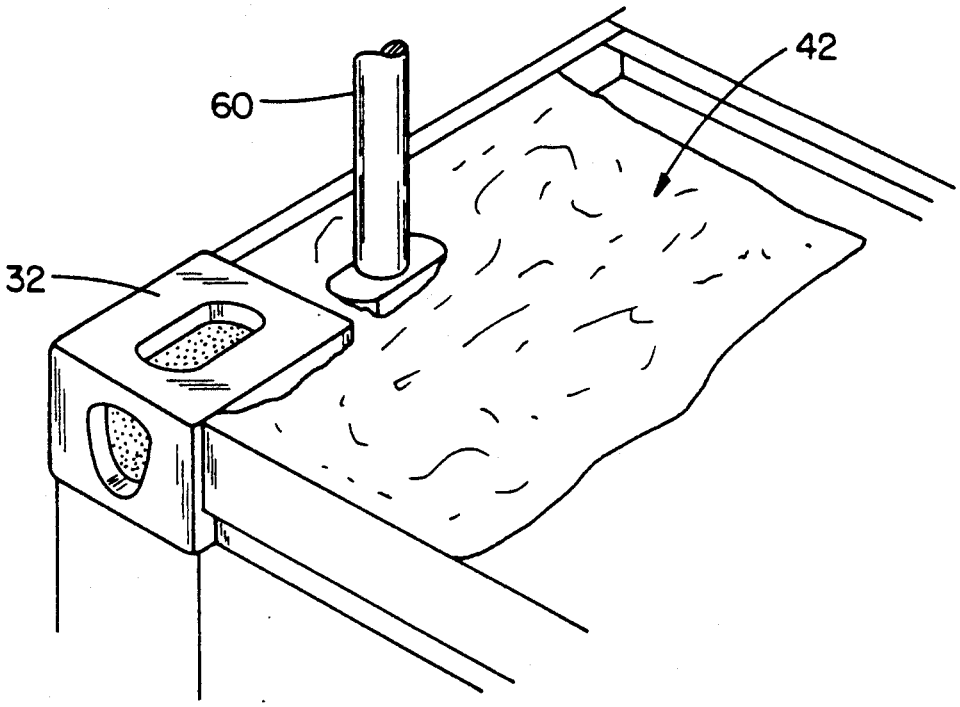
FIG. 6 is similar to FIG. 3, but shows how a twist arm of a spreader bar may impact the energy absorption pad.
Figure 7:
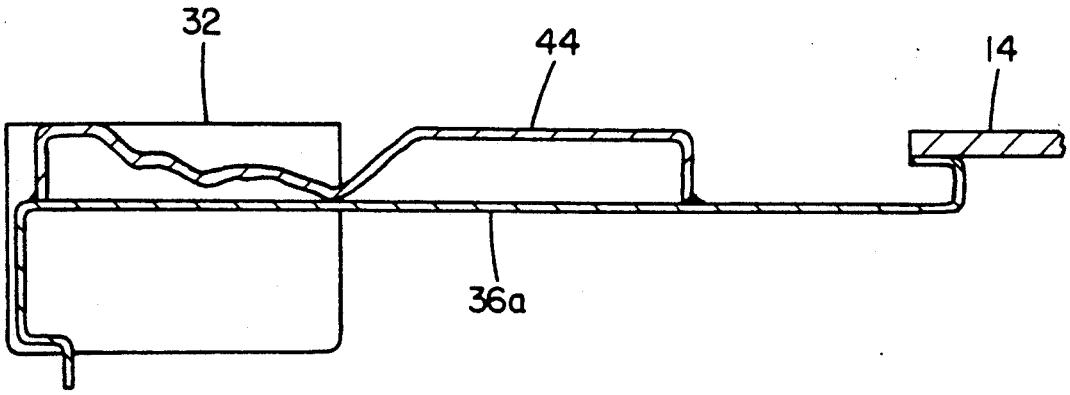
FIG. 7 is similar to FIG. 5, but shows how repeated impacts may dent the energy absorption pad.

In use, and with reference to FIG. 6, if a connecting or locking arm 60 of a spreader bar is lowered onto energy absorption pad 42, that pad will dent and absorb the energy of the spreader bar, preventing the locking arm thereof from damaging the body of container 10. With reference to FIG. 7, over time, repeated impacts of such locking arms will cause top plate 44 of energy absorption pad 32 to flatten against the container body, and thus the presence of flat bottom areas in the deformed portion of top plate 44 indicates that this plate has started to flatten against the adjacent header. At this point, energy absorption pad 42 can be replaced with another pad to insure continued protection of the upper top corners of the container 10, and this can be done by removing energy absorption pad 42 and securing another similar or identical pad in its place. If energy absorption pad 42 is welded to header 36, the pad can be replaced by cutting it from the header, for example by a blow torch, and welding a new energy absorption pad in its place.

Figure 8:
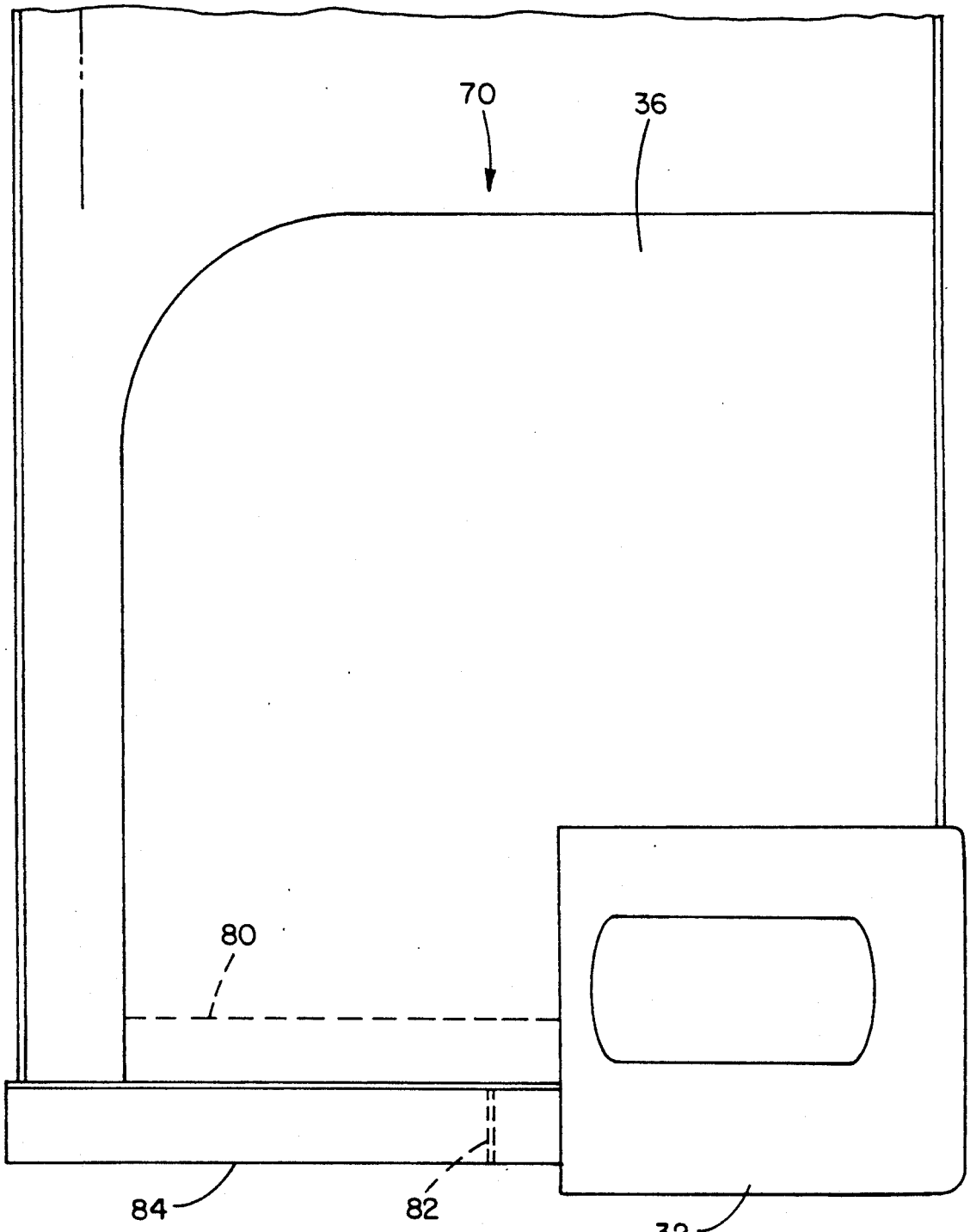
FIG. 8 is a plan view of an alternate energy absorption pad.
Figure 9:
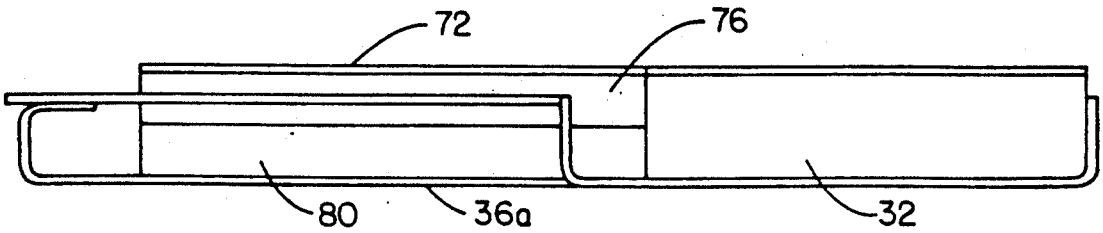
FIG. 9 is a side view of the energy absorption pad of FIG. 8.
Figure 10:
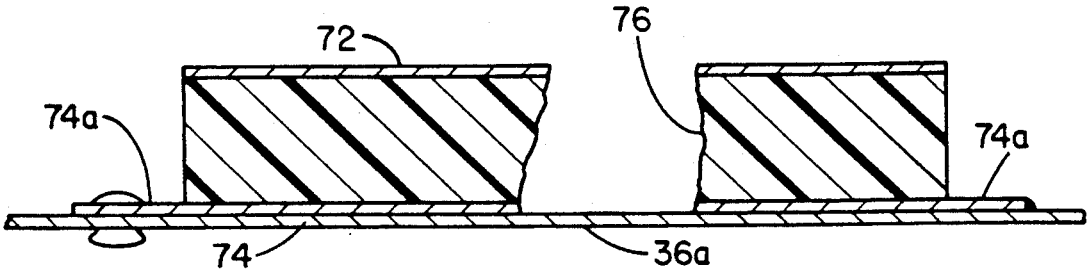
FIG. 10 is a partial cross-sectional view through the energy absorption pad of FIG. 8.

As described above, energy absorption pad 42 has a substantially hollow interior. Alternatively, the energy absorption pad may be substantially or completely filled, and FIGS. 8–10 show one such pad, referenced at 70, and generally comprising top plate 72, bottom plate 74, and body 76 sandwiched between these two plates. Plates 72 and 74 and body 76 may be comprised of any suitable material; and for instance, plates 72 and 74 may be made from metal, plastic, or a composite of metal and plastic, and body 74 may be made from a resilient plastic such as neoprene. In addition, body 76 may be connected to plates 72 and 74, and pad 70 may be connected to header 36, in any acceptable manner. For example, body 76 may be adhesively secured to plates 72 and 74, and pad 70 may be connected to header 36 by welding, riveting, or both. Bottom plate 74 may be provided with peripheral flange 74*a* projecting outside body 76 and top plate 72 to facilitate connecting the energy absorption pad 70 to header 36.

Figure 11:
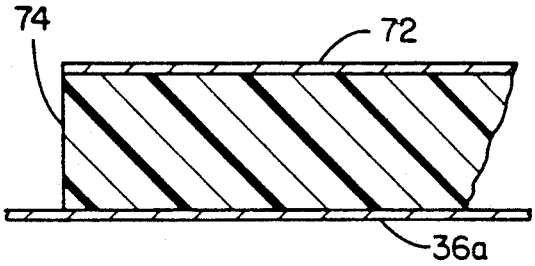
FIG. 11 is a partial cross-sectional view through another alternate energy absorption pad.
Figure 12:
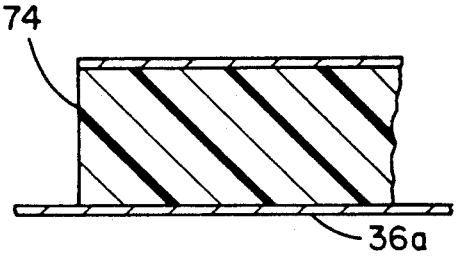
FIG. 12 is a partial cross-sectional view through still another embodiment of the energy absorption pad.

FIGS. 11 and 12 show two alternate embodiments of absorption pad 70, in which body 76 is bonded directly to header 36, so that bottom plate 74 is not required. Indeed, with the embodiment of FIG. 12, the top surface of body 76 is left uncovered, so that this embodiment does not require either top or bottom plates 72 and 74.

Preferably, means are provided to drain liquids through pad 70, from the area directly behind the energy absorption pad; and, with particular reference to FIGS. 8 and 9, this drain mean may comprise passages 80 and 82. Passageway 80 is formed in body 76 and extends forward from the back side thereof, preferably directly above header 36 or bottom plate 74, and to corner member 32. Passageway 80 is formed in the container body, specifically a top longitudinal beam 84, slightly rearward of corner member 32; and passageway 82 extends laterally between, and is in fluid communication with, passageway 80 and the ambient. In use, liquids collecting immediately rearward of pad 70 drain forward, through passageway 80, and then laterally outward through passageway 82, to the ambient.

Container 10 preferably includes four bottom corner members 34 that may be used to lock the container onto a support member or similar device. To protect the areas of the container body adjacent these bottom corner members from accidental impact as the cargo container is lowered onto or otherwise connected to a support member, container 10 may be provided with bottom energy absorption pads 88, immediately adjacent the bottom corner members. The general construction and placement of these bottom energy absorption pads 88 are analogous or very similar to the construction and placement of the top energy absorption pads 42, and thus it is unnecessary to describe the bottom energy absorption pads in detail. As will be understood by those of ordinary skill in the art, container 10 may be provided with the bottom corner energy absorption pads in addition to, or instead of, the top corner energy absorption pads. Moreover, because it is unlikely that any significant amount of water would collect on the bottom of container 10 immediately forward or rearward of the bottom energy absorption pad, it may be unnecessary to provide these bottom energy absorption pads with any drain means to drain liquid through those pads.

With the embodiment of container 10 shown in FIGS. 1 and 2, support posts 30 are located at the corners of the container. Often, a cargo container has support posts that are spaced from the front and back planes of the container, and this is done so that the front and back support posts of different length containers may be located a uniform distance apart. For instance, with a 40 ft. length container, the support posts are conventionally located at the corners of the container. However, with a 45 ft. length container, conventionally a forward pair of support posts are located 2½ ft. behind the front end of the container, and a rearward pair of support posts are positioned 2½ ft. forward of the back end of the container, so that the forward pair of support posts are spaced approximately 40 ft. from the rearward pair of support posts. With this arrangement, these different length containers may be stacked one above another, with the support posts of one container located directly above the support posts of a lower container.

With these containers that have support posts located between the ends of the containers, upper and lower members similiar or identical to members 32 and 34 described above, are usually located on the top and bottom ends, respectively, of the support posts, and the containers are handled by means of those posts end members in the same general manner in which container 10 is handled. Thus, the areas of these containers immediately adjacent to the post end members may be damaged in a same way that the areas of container 10 immediately adjacent corner members 32 and 34 may be damaged, and containers having support posts spaced from the corners of the container may embody the present invention to protect the areas of the containers adjacent to the post end members.

Figure 13:
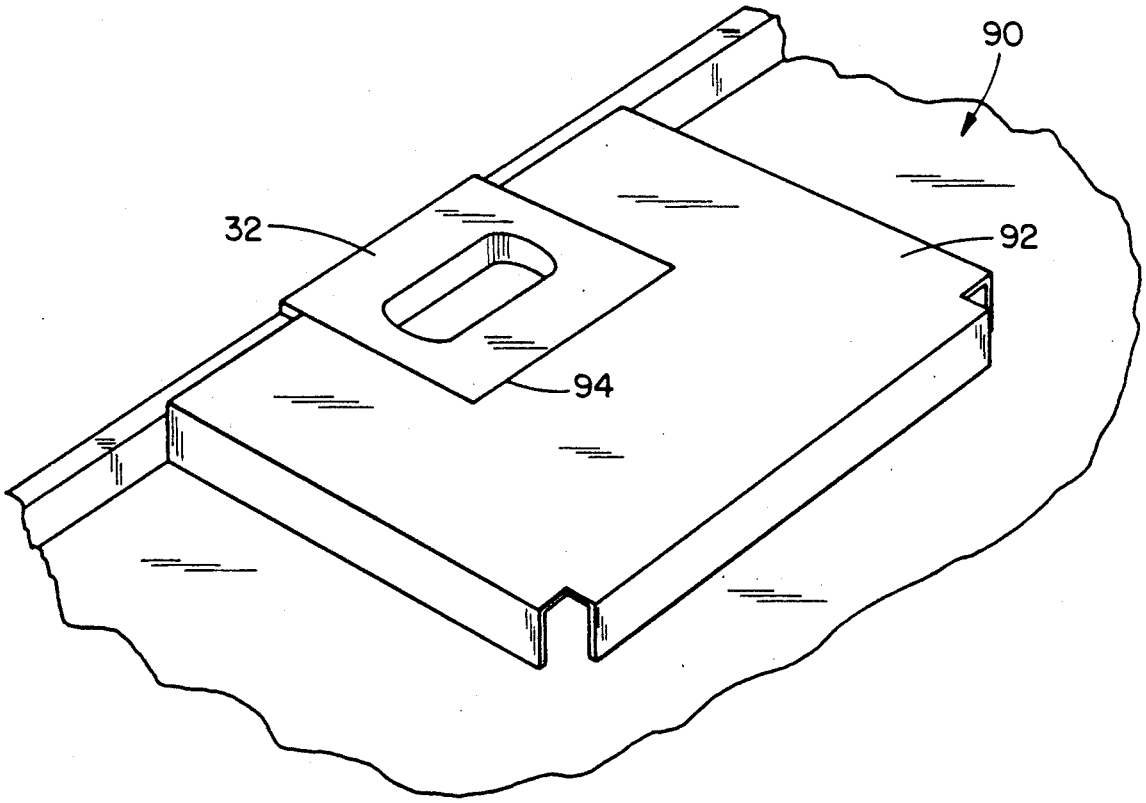
FIG. 13 is a perspective view of a portion of an alternate cargo container also embodying this invention.

FIG. 13 illustrates a portion of a container 90 having a support post (not shown) and a post end member 32 located along the side of the container but spaced from the end plane of the container, and also shows an energy absorption pad 92 mounted on the container immediately adjacent member 32 to protect the container from impact damage. Pad 92 is very similiar to pad 42, and it is unnecessary to describe pad 92 herein in detail. The primary difference between pad 92 and pad 42 is that the former pad extends immediately along three sides of the adjacent post end member, and in particular includes a recess 94*a* spaced from the lateral sides of the pad, with post end member 32 complementarily fitting into this central recess. As will be understood by those of ordinary skill in the art, pad 70 shown and in FIGS. 8–12 may also be employed with container 90.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

I claim:

1. A method of protecting a cargo container of the type having a body defining the shape of the container, and forming an interior cargo space, and including a roof, a floor, front and back walls, left and right side walls, a pair of support posts, a header extending between the support posts, and a plurality of post end members connected to the support posts to facilitate handling the cargo container, the method comprising the steps o:

welding an energy absorption pad to an area of the header immediately adjacent one of the post end members, to protect said area from container handling equipment, wherein in use, the handling equipment strikes and dents the energy absorption pad;

cutting the energy absorption pad from the header; and welding a replacement energy absorption pad to said area of the header to further protect said area from the container handling equipment.

2. A method according to claim 1, wherein the energy absorption pad has a top plate, and wherein:

the step of welding the energy absorption pad to the header includes the step of welding the energy absorption pad to the header with the top plate of the energy absorption pad spaced above said header, and wherein in use, container handling equipment dents the top plate against the header; and the cutting step includes the step of cutting the energy absorption pad away from the header after a portion of the top plate is dented against the header.

3. A method according to claim 2, wherein the one post end member includes a generally planar top surface, and the step of welding the energy absorption pad to the header further includes the step of welding the energy absorption pad to the header with the top plate of the energy absorption pad co-planar with the top surface of said one post end member.

4. A method according to claim 3, wherein the energy absorption pad defines a corner recess, and wherein the step of welding the energy absorption pad to the header includes the step of welding the energy absorption pad to the header with the one post end member complementarily fitting into the recess of the energy absorption pad.

5. A method according to claim 1, wherein the energy absorption pad has a top plate, and the step of welding the energy absorption pad to the header includes the steps of:

placing the energy absorption pad on the header with the top plate of the energy absorption pad spaced above the header, wherein the energy absorption pad, the header, and the roof of the container form a recess behind the energy absorption pad; and forming a drain passageway between the energy absorption pad and the header to conduct liquids forward through the absorption pad from said recess.

* * * * *